US008752905B1

(12) United States Patent
Bearly

(10) Patent No.: US 8,752,905 B1
(45) Date of Patent: Jun. 17, 2014

(54) ICE BREAKING / RUBBLIZING MACHINE

(71) Applicant: Philip Bruce Bearly, Loveland, CO (US)

(72) Inventor: Philip Bruce Bearly, Loveland, CO (US)

( * ) Notice: Subject to any disclaimer, the term of this patent is extended or adjusted under 35 U.S.C. 154(b) by 0 days.

(21) Appl. No.: 13/688,167

(22) Filed: Nov. 28, 2012

(51) Int. Cl.
*E01H 5/04* (2006.01)
*E01H 5/12* (2006.01)

(52) U.S. Cl.
CPC ... *E01H 5/04* (2013.01); *E01H 5/12* (2013.01)
USPC ..... 299/25; 299/40.1; 37/242

(58) Field of Classification Search
USPC ..... 299/24, 25, 36.1, 39.1, 39.9, 40.1, 71, 299/85.1; 37/219, 220, 221, 222, 223, 224, 37/205, 209, 242, 244, 245, 196
See application file for complete search history.

(56) References Cited

U.S. PATENT DOCUMENTS

| | | | | |
|---|---|---|---|---|
| 101,613 | A | 4/1870 | Hallock | |
| 721,364 | A | 2/1903 | Green et al. | |
| 1,791,865 | A * | 2/1931 | Fordyce | 299/39.9 |
| 2,156,066 | A | 4/1939 | Royer et al. | |
| 2,197,549 | A | 4/1940 | Hargrave et al. | |
| 2,223,213 | A | 11/1940 | Kersten | |
| 2,319,520 | A | 5/1943 | Rypkema | |
| 2,336,079 | A * | 12/1943 | Eustis et al. | 37/105 |
| 2,400,906 | A | 5/1946 | Beck | |
| 2,604,026 | A * | 7/1952 | Latta | 172/549 |
| 2,646,730 | A | 7/1953 | Vig et al. | |
| 2,714,506 | A | 8/1955 | Hansen | |
| 3,094,315 | A | 6/1963 | Yetter | |
| 3,580,638 | A | 5/1971 | Pullen | |
| 3,639,005 | A | 2/1972 | Holm | |
| 3,761,133 | A | 9/1973 | Buckley | |
| 4,261,618 | A | 4/1981 | Davis | |
| 4,304,440 | A | 12/1981 | Posciri | |
| 4,348,059 | A | 9/1982 | Morgan | |
| 4,724,662 | A * | 2/1988 | Giandenoto et al. | 56/256 |
| 5,106,165 | A | 4/1992 | Lattman | |
| 5,201,353 | A * | 4/1993 | Weill | 144/236 |
| 6,531,656 | B1 | 3/2003 | Grote et al. | |
| 6,643,729 | B2 | 11/2003 | Sasaki et al. | |
| 7,587,843 | B2 | 9/2009 | Demers | |
| 8,528,308 | B2 * | 9/2013 | Priepke | 56/15.8 |

* cited by examiner

*Primary Examiner* — David Bagnell
*Assistant Examiner* — Michael Goodwin
(74) *Attorney, Agent, or Firm* — Barber Legal; Craig W. Barber

(57) ABSTRACT

An ice breaking machine has a frame adapted to be mounted on a vehicle, and two subframes rotatably connected thereunder. The subframes in turn carry axles on which are mounted a plurality of wheel assemblies each composed of a wheel with six point mounts carrying six standard heavy equipment teeth. The wheels are keyed to the axle, with a mathematical relationship between the angles of the keyways of adjoining wheels so that the teeth of each wheel are slightly out of line with the teeth of the wheels on either side.

10 Claims, 7 Drawing Sheets

ICE BREAKING / RUBBLIZING MACHINE

STATEMENT REGARDING FEDERALLY FUNDED RESEARCH

This invention was not made under contract with an agency of the US Government, nor by any agency of the US Government.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

CROSS-REFERENCE TO RELATED APPLICATIONS

N/A

FIELD OF THE INVENTION

This invention relates generally to road equipment, and specifically to road equipment used to break ice into rubble.

BACKGROUND OF THE INVENTION

Each year in the United States local governments spend hundreds of millions of dollars on the removal of ice and snow from public roadways. While winter snow provides a source of tourism business for skiing, snow-boarding, and other winter sports, it also presents a hazard to traffic, both vehicular and foot.

Snow removal at least allows the use of blades which can push the snow around, as the snow is loose. Ice, however, presents a much more serious removal problem. Heavy traffic, either vehicular or foot, compacts snow into ice and then prevents the use of normal snow removal equipment. Worse, the daily cycle of warming and nightly refreezing rapidly hardens the packed ice into a solid mass.

Manual removal of this ice is a tedious and time consuming job and is simply impractical for any area larger than a single sidewalk. Chemical removal poses other hazards to contaminated water supplies and vegetation, and to vehicle corrosion, wildlife and so on.

Since ice is a solid mineral, it can become quite hard and impervious to most of the usual heavy equipment used against it. Even machines which can break up ice usually do so only very slowly, one piece at a time, while causing accelerated wear and damage to the equipment.

Ice breaking machinery is known in the art. Some typical examples include rollers (drums) mounted beneath graders, the rollers having teeth projecting from them to break up the ice as they pass across it. However, the hardness of the ice and the frequent impact with curbs, gutters, rocks, parking bollards and the like mean that such teeth quickly get broken off. At that point the municipality is forced to buy an entirely new roller drum or go through a very long and expensive repair process with the roller drum. Various types of machines may be found in this area, for example, that of U.S. Pat. No. 4,304,440, designed for use on the front of equipment such as bulldozers and having staggered rows of teeth which are, unfortunately, non-standard teeth and very difficult to remove and replace.

U.S. Pat. No. 3,761,133 shows a device having offset keyways, but the teeth of that device indicate that it only functions with a counter-clockwise rotation and therefore cannot be reversed.

A slightly better solution may be found in those devices such as that sold under the name "Icebuster", under U.S. Pat. No. 5,106,165. This device has a long roller bearing standard heavy equipment teeth, but since it allows no give across the width of the camber of a road, it fails to effectively break up all ice. In addition, the wheels are bolted and keyed to one another, not to the axle, preventing efficient assembly and disassembly. Worse, the bearings used on the axle of the device fail with extreme frequency, both due to the lack of give for camber, meaning the axle is beaten against the road surface with extreme torque and due to the choice of polymer bearings ("Tubular Blue Nylon" bearings, see reference numeral 44) for the application.

It would be preferable to provide a durable and effective icebreaking device.

SUMMARY OF THE INVENTION

General Summary

The present invention teaches an icebreaker which overcomes these disadvantages by the use of carefully selected bearings, the use of replaceable standardized teeth and by arranging the teeth so that they are slightly out of line with the teeth in the wheels on either side.

A frame having strong members carries underneath itself two subframes on trunnions which allow the subframes to articulate slightly to adjust for the camber of the road. Each subframe carries an axle on which the wheel assemblies are mounted. The wheel assemblies are keyed to the axles so that the entire axle stack of wheel assemblies rotates as a single unit. The wheel assemblies each have a central wheel with projecting teeth, the teeth are standardized and can be exchanged for similar teeth or even for other types of teeth. In addition, each wheel assembly has two keyways for the key, and the keyways are mounted at a radial angle to one another of a multiple of N/X degrees, where "N" is the angular separation of teeth on each wheel from each other and X is a whole number, preferably three. By using one keyway on the first wheel, then the second keyway on the second wheel, and then flipping the third wheel and using the second keyway, the result is that three wheels in a row may have different angles relative to the axle and thus the teeth will not be exactly in line, resulting in greatly improved icebreaking efficiency with easily replaceable teeth.

Summary in Reference to Claims

It is therefore another aspect, advantage, objective and embodiment of the present invention, in addition to those mentioned previously, to provide an ice breaking apparatus adapted to be mounted upon a vehicle; said apparatus comprising:

a frame having a mount;

the frame having a forward transverse member and a rear transverse member, the forward transverse member having thereon two sealed spherical plain bearings, the rear transverse member having thereon a further two sealed spherical plain bearings, a first one of the two sealed spherical plain bearings on the forward transverse member facing a first one of the two sealed spherical plain bearings on the rear transverse member, a second one of the two sealed spherical plain bearings on the forward transverse member facing a second one of the two sealed spherical plain bearings on the rear transverse member, whereby first and second facing pairs of sealed spherical plain bearings are made;

a first subframe having at least one pair of trunnion mounts in line with and in between the first pair of sealed spherical plain bearings on the frame, the first pair of sealed spherical plain bearings of the frame and the pair of trunnion mounts of the first subframe having passing therethrough a first trunnion; whereby the first subframe is rotatably supported by the frame;

a second subframe having at least one pair of trunnion mounts in line with and in between the second pair of sealed spherical plain bearings on the frame, the second pair of sealed spherical plain bearings of the frame and the pair of trunnion mounts of the second subframe having passing therethrough a second trunnion; whereby the second subframe is rotatably supported by the frame;

first and second downward extensions on first and second ends of the first subframe having respective first and second facing pillow block bearings thereon to form a first pair of pillow block bearings;

first and second downward extensions on first and second ends of the second subframe having respective first and second facing pillow block bearings thereon to form a second pair of pillow block bearings;

the first pair of pillow block bearings carrying therethrough a first axle disposed underneath the first subframe and perpendicular to the first trunnion;

the second pair of pillow block bearings carrying therethrough a second axle disposed underneath the second subframe and perpendicular to the second trunnion;

the first axle having a first longitudinal keyway, the keyway having a longitudinal key therein, the first axle carrying thereon a first plurality of adjoining wheel assemblies;

the second axle having a second longitudinal keyway, the keyway having a longitudinal key therein, the second axle carrying thereon a second plurality of adjoining wheel assemblies;

each wheel assembly comprising a wheel having a circumference, the circumference bearing regularly spaced projecting point mounts with an angular separation of "N" degrees between adjoining point mounts; the point mounts having pin apertures passing therethrough;

each of the point mounts being a projection dimensioned and configured to accept thereon a standard asymmetrical heavy equipment tooth held to the point mount by means of a pin passing through the tooth and point mount, the teeth of a single wheel being oriented in a single handedness direction;

the wheel having an aperture therethrough, the wheel carried by one of the two axles passing through the aperture, the aperture having first and second keyways therethrough, the key passing through one of the two keyways and locking the wheel assemblies to prevent rotation in relation to one another, the first and second keyways separated by an angle which is a whole number multiple of N/X degrees, where "X" is itself a second whole number divisible by three;

and further wherein the wheel assemblies are carried on the axle in a particular order, with a first wheel having teeth oriented in a first direction and the key passing through the first keyway; an adjoining second wheel having teeth oriented in the first direction and the key passing through the second keyway, and a third wheel adjoining the second wheel, the third wheel having the teeth oriented in a second direction but the third wheel being flipped 180 degrees from the first and second wheels and having the key passing through the second keyway, whereby each of the three wheels is mounted at a different angle.

It is therefore another aspect, advantage, objective and embodiment of the present invention to provide an ice breaking apparatus, wherein "N" is 60 degrees, "X" the second whole number is 3, and N/X is thus 20 degrees, and thus whereby the first and second keyways are separated by an angle which is the whole number multiple of 20 degrees.

It is therefore another aspect, advantage, objective and embodiment of the present invention to provide an ice breaking apparatus, wherein the whole number is 10, whereby the first and second keyways are separated by an angle of 200 degrees.

It is therefore another aspect, advantage, objective and embodiment of the present invention to provide an ice breaking apparatus, whereby each axle bears at each end a spiral-locking-ring, and where each trunnion bears at each end a spiral-locking-ring, and where in trunnion also bears a spiral-locking-ring disposed inward of the sealed spherical plain bearings, whereby the wheel assemblies, and subframes are secured onto the axles.

It is therefore another aspect, advantage, objective and embodiment of the present invention to provide an ice breaking apparatus, wherein the frame further comprises a plurality of vertical members attached to and rising from the rear transverse member; and further comprises an upper rear transverse member parallel to the rear transverse member and above it, the upper rear transverse member attached to such vertical members, and further comprises diagonal members attached to the upper rear transverse member and the forward transverse member, and yet further comprises horizontal members attached to such forward and rear transverse members.

It is therefore another aspect, advantage, objective and embodiment of the present invention to provide an ice breaking apparatus, further comprising at least one spacer upon each axle at a location directly beneath the respective trunnion.

It is therefore another aspect, advantage, objective and embodiment of the present invention to provide an ice breaking apparatus, whereby the shape of the wheel is multi-sided.

It is therefore another aspect, advantage, objective and embodiment of the present invention to provide an ice breaking apparatus, wherein the aperture further comprises raised lands about the aperture, the raised lands having a width greater than the width of the wheel assembly so that adjoining wheels are maintained in a spaced apart relationship; the raised lands having reliefs disposed within the aperture at the keyways.

It is therefore another aspect, advantage, objective and embodiment of the present invention to provide an ice breaking apparatus, further comprising: spacer rings carried upon the axles in between each pair of adjoining wheels, whereby the adjoining wheels are maintained in a spaced apart relationship.

It is therefore another aspect, advantage, objective and embodiment of the present invention to provide an ice breaking apparatus adapted to be mounted upon a vehicle, said apparatus comprising:

a frame;

the frame having a forward transverse member and a rear transverse member, the forward transverse member having thereon a sealed spherical plain bearing, the rear transverse member having thereon a second sealed spherical plain bearing, the first and second sealed spherical plain bearings facing one another, a subframe having at least one pair of trunnion mounts in line with and in between the first pair of sealed spherical plain bearings on the frame, the first pair of sealed spherical plain bearings of the frame and the pair of trunnion mounts of the first subframe having passing therethrough a trunnion; whereby the first subframe is rotatably supported by the frame;

first and second downward extensions on first and second ends of the subframe having respective first and second facing pillow block bearings thereon to form a pair of pillow block bearings;

the pair of pillow block bearings carrying therethrough an axle disposed underneath the subframe and perpendicular to the trunnion;

the axle having a longitudinal keyway, the keyway having a longitudinal key therein, the axle carrying thereon a plurality of adjoining wheel assemblies;

each wheel assembly comprising a wheel having a circumference, the circumference bearing regularly spaced projecting point mounts with an angular separation of "N" degrees between adjoining point mounts; the point mounts having pin apertures passing therethrough;

each of the point mounts being a projection dimensioned and configured to accept thereon a standard asymmetrical heavy equipment tooth held to the point mount by means of a pin passing through the tooth and point mount, the teeth of a single wheel being oriented in a single handedness direction;

the wheel having an aperture therethrough, the wheel carried by the axle passing through the aperture, the aperture having first and second keyways therethrough, the key passing through one of the two keyways and locking the wheel assemblies to prevent rotation in relation to one another, the first and second keyways separated by an angle which is a whole number multiple of N/X degrees, where "X" is itself a second whole number divisible by three;

and further wherein the wheel assemblies are carried on the axle in a particular order, with a first wheel having teeth oriented in a first direction and the key passing through the first keyway; an adjoining second wheel having teeth oriented in the first direction and the key passing through the second keyway, and a third wheel adjoining the second wheel, the third wheel having the teeth oriented in a second direction but the third wheel being flipped 180 degrees from the first and second wheels and having the key passing through the second keyway, whereby each of the three wheels is mounted at a different angle relative to the axle.

INDEX TO REFERENCE NUMERALS

Figure 1:
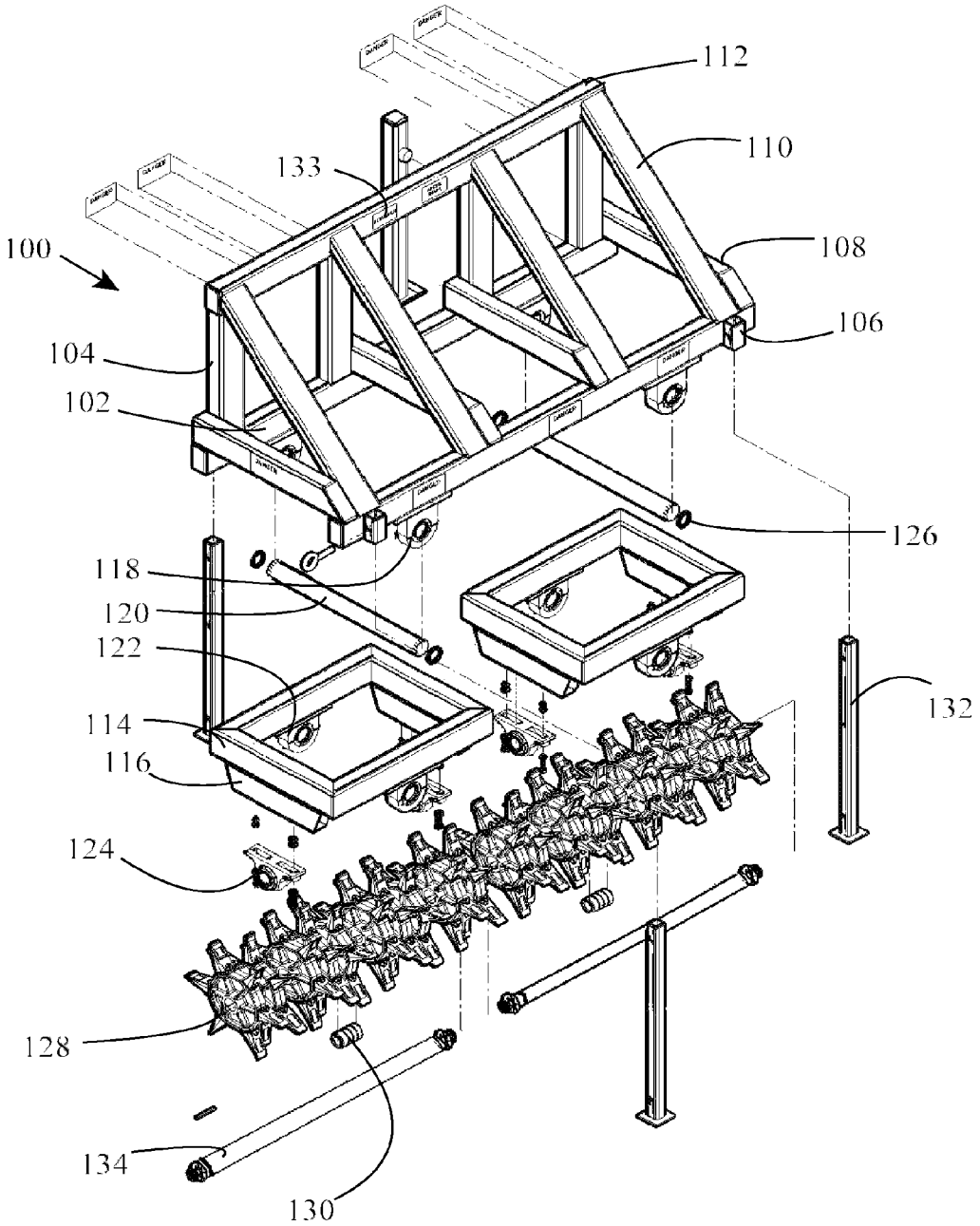
FIG. 1 is a perspective exploded view of an exemplary first preferred embodiment of the invention.

Ice breaking/rubblizer apparatus 100
Rear transverse frame member 102
Vertical frame member 104
Front transverse frame member 106
Horizontal frame member 108
Diagonal frame member 110
Upper rear frame member 112
Subframe 114
Downward extension of subframe 116
Sealed spherical plain bearing (frame) 118
Trunnion (trunnion shaft) 120
Subframe trunnion mount 122
Pillow block bearing 124
Spiral-locking-ring (i.e. Spirolox™) 126
Stack of wheel assemblies 128
Spacer rings 130
Storage support 132
Safety notices 133
Axle 134
Storage mount 136
First wheel (first angle) 202
Second wheel (second angle) 204
Third wheel (third angle) 206
Key 210
Keyway (axle) 214
Wheel assembly 300
Point mount 302
Point mount hole 304
Heavy machinery tooth 306
Tooth hole 308
Aperture 312
First keyway (wheel) 314
Second keyway (wheel) 316
Raised land 318
Relief 320
Direction of teeth orientation 322
Angle between teeth, "N" 400
Multiple of N/X, separation of keyways 402
Angle N/X 404
Ice breaker 500
Axle 502

DETAILED DESCRIPTION

In order to avoid prolixity and maintain clean diagrams, only a single member of each type of element of the invention is labeled.

In the presently preferred embodiment and best mode presently contemplated for carrying out the invention, FIG. 1 is a perspective exploded view of an exemplary first preferred embodiment of the invention. Mounts for adapting the machine to a vehicle may be standard types. The ice breaking/rubblizer apparatus has an extremely sturdy frame 100 with a rear transverse frame member 102, vertical frame members 104, front transverse frame member 106, horizontal frame members 108, diagonal frame members 110 and an upper rear frame member 112. As may be seen, these members may advantageously be box beam construction, however, other constructions such as angle beams, I beams, and so on may be used, as well as solid members.

Subframe 114 sits underneath the frame 100, the subframe having a downward extension of subframe 116 at each of the ends. Subframe 114 is connected in a rotatable manner to the frame by means of two sealed spherical plain bearings (frame bearings 118) and two subframe trunnion mounts which sit in pairs facing each other so that trunnion 120 may pass through all four of them. Trunnion 120 is thus free to rotate and with it, subframe 114. This may allow the device to adapt or articulate (in the "roll" axis) to irregularities in the ice, the camber of the road and so on. In fact, the sealed spherical plain bearings allow limited three dimensional motion, up to 6 degrees.

Spiral-locking-rings 126 are an important feature of the ease of use of the machine. Typical spiral-locking-rings may be those manufactured and sold under the Spirolox Trademark. (Not affiliated with applicant.) These rings are extremely strong and yet are also very easy to remove from the ends of axles and trunnions when maintenance is necessary: often a mere screwdriver is sufficient to allow unwinding and removal of a ring capable of holding many tons of pressure during use.

These various types of bearings may be greasable as well, unlike polymer bearings which may be greased but which promptly lose the grease load through pressure, or for other reasons.

Storage support 132 is a stand or jack which fits into the mounts on the device so that when not in use, the device may be stored upright and off the ground.

Safety notices 133 are self-evidently used as warning indicia, instructions and so on and may advantageously be painted or stuck to the frame of the machine.

Figure 3:
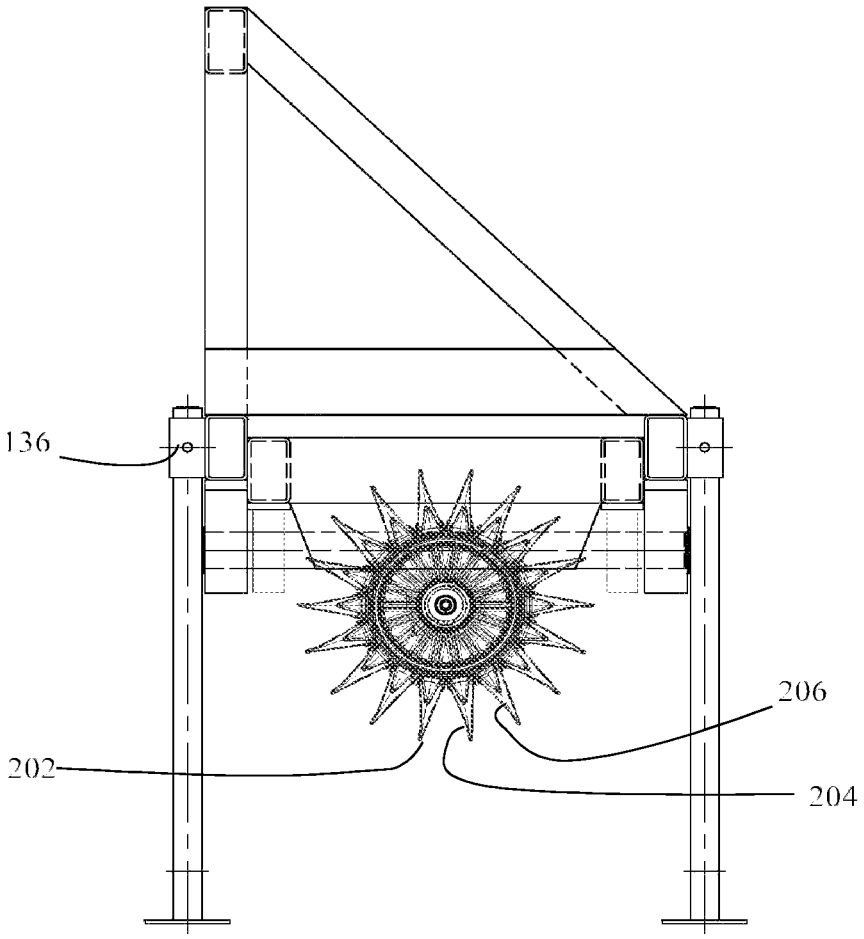
FIG. 3 is a side view depicting several embodiments of the invention.

Storage mount 136 is visible in FIG. 3, but resembles the mounts seen in FIG. 1: storage jack mounts, or other mounts may be used.

Spiral-locking-rings 126 are an important feature of the ease of use of the machine. Typical spiral-locking-rings maybe those manufactured and sold under the Spirolox Trademark. (Not affiliated with applicant.) These rings are extremely strong and yet are also very easy to remove from the ends of axles and trunnions when maintenance is necessary: often a mere screwdriver is sufficient to allow unwinding and removal of a ring capable of holding many tons of pressure during use.

Figure 2:
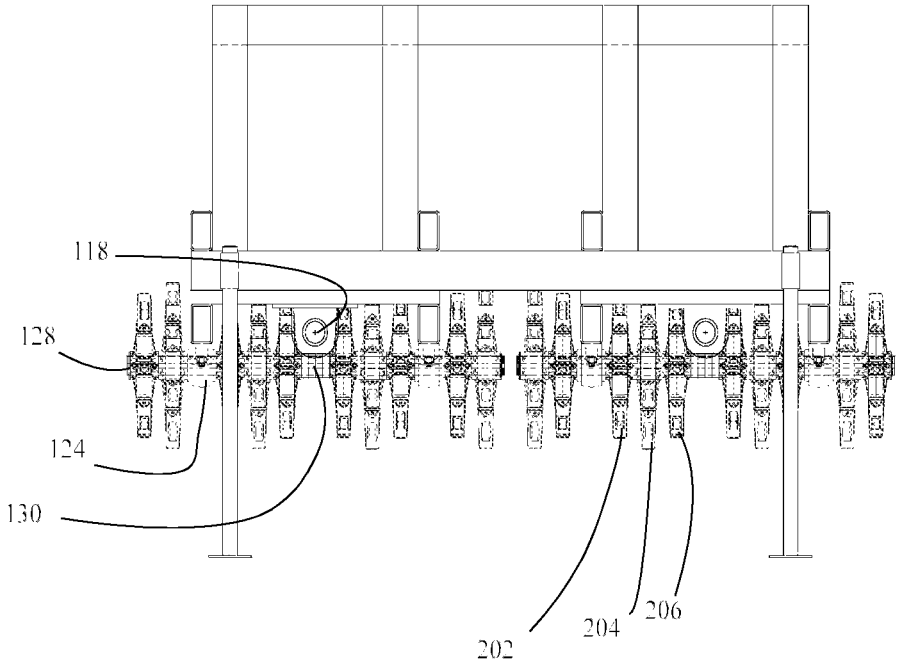
FIG. 2 is a front view of an exemplary embodiment of the invention.

FIG. 2 is a front view of an exemplary embodiment of the invention. As may be clearly seen, the two axles on the two subframes allow a full road lane span of the machine and yet allow it to adapt to the camber of the road. In this view, the fact that the trunnions and the axle bearings both interrupt the line of wheel assemblies may also be seen.

Examining wheel assemblies, the FIG. 2 also shows differences between first wheel (at a first angle) 202, second wheel assembly (second angle) 204 and third wheel assembly (at yet a third angle) 206, even though the wheel assemblies are virtually almost identical. This is because each of the three wheel assemblies is actually seen at a slightly different angle, as well will be understood better during the discussion of FIGS. 5 and 6.

FIG. 3 is a side view depicting several embodiments of the invention, and the angular difference between wheel assemblies 202, 204 and 206 is now apparent. While the side view appears to show a single wheel with 18 teeth, in fact each of the three wheels is at a slightly different radial angle upon the axle and thus the teeth are staggered.

Figure 4:
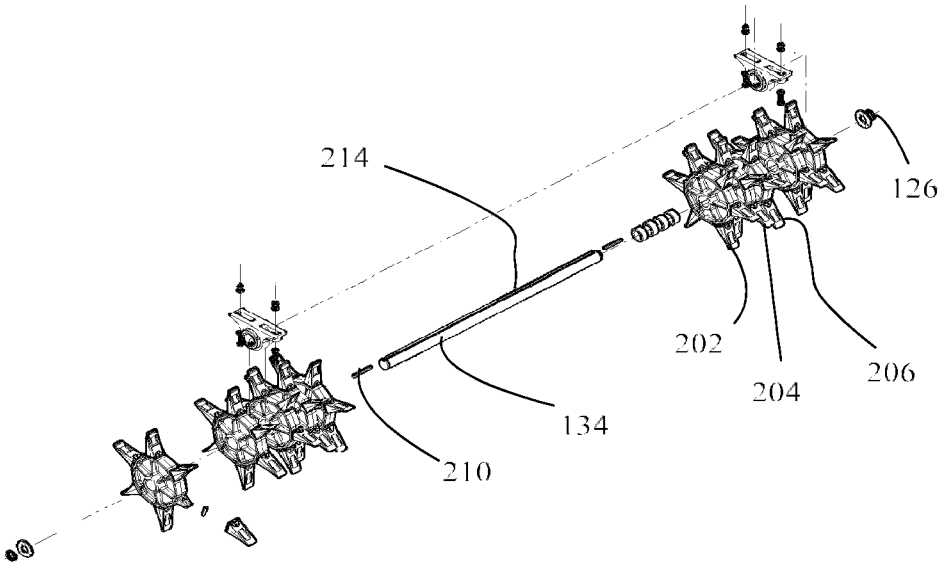
FIG. 4 is a perspective exploded view of an exemplary axle embodiment of the invention.

FIG. 4 is a perspective exploded view of an exemplary axle embodiment of the invention. Importantly, key 210 is seen sitting in keyway 214 of axle 134. The key 210 fits within keyways of the wheel assemblies and thus prevents them from rotating individually, which would be disadvantageous in breaking ice. However, reference to wheel assemblies 202, 204 and 206 shows that these identical wheels nonetheless sit on the axle 134 at different angles.

This is explained by reference to FIG. 5, which is a perspective and partially exploded view of a wheel assembly exemplary embodiment of the invention. Wheel assembly 300 has a number of point mounts 302 each having a point mount hole 304 passing therethrough and a standardized "Hensley-Style" heavy machinery tooth 306 thereon, secured by pin 310 passing through tooth hole 308 and point mount hole 304.

Aperture 312 accepts the axle 134 while keyway 314 OR keyway 316 accepts the key 210. However, while the wheels sit at three angles, only two keyways are needed, because a wheel may be flipped over. Raised land 318 allows the omission of spacer rings between the individual wheels in the preferred embodiment.

Relief 320 (a wider part of the aperture and part of the keyway) allows efficient low cost machining of the keyways even though the raised lands 318 make the wheel assembly quite wide.

Figure 5:
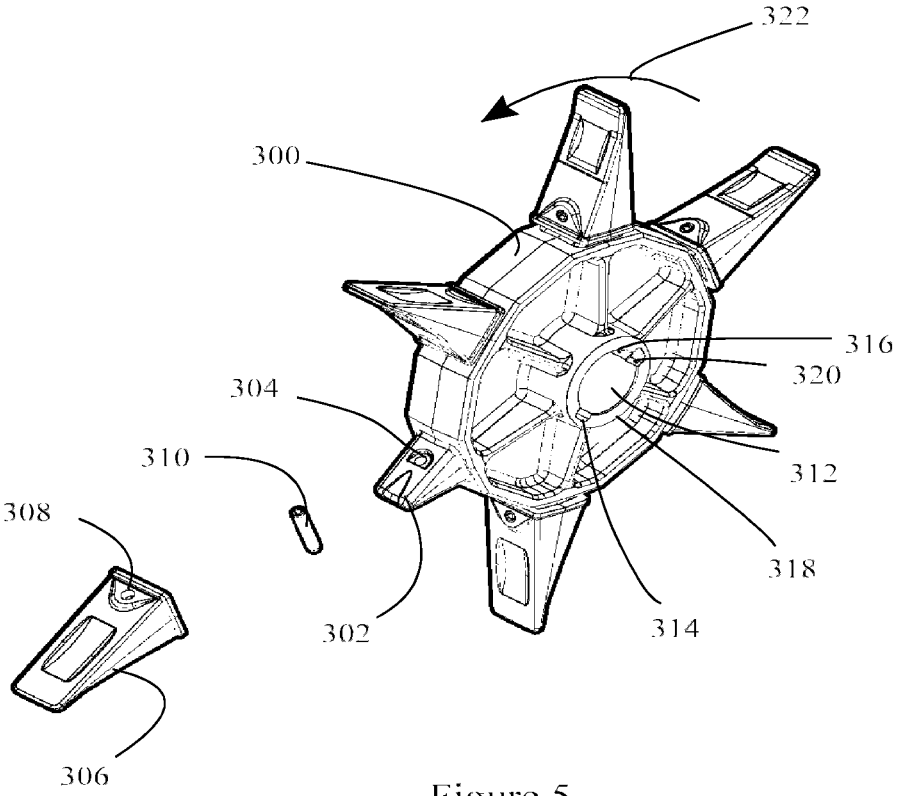
FIG. 5 is a perspective and partially exploded view of a wheel assembly exemplary embodiment of the invention.

Direction of teeth orientation 322 may be seen in FIG. 5: all six teeth are oriented in the counter-clockwise direction as seen.

Figure 6:
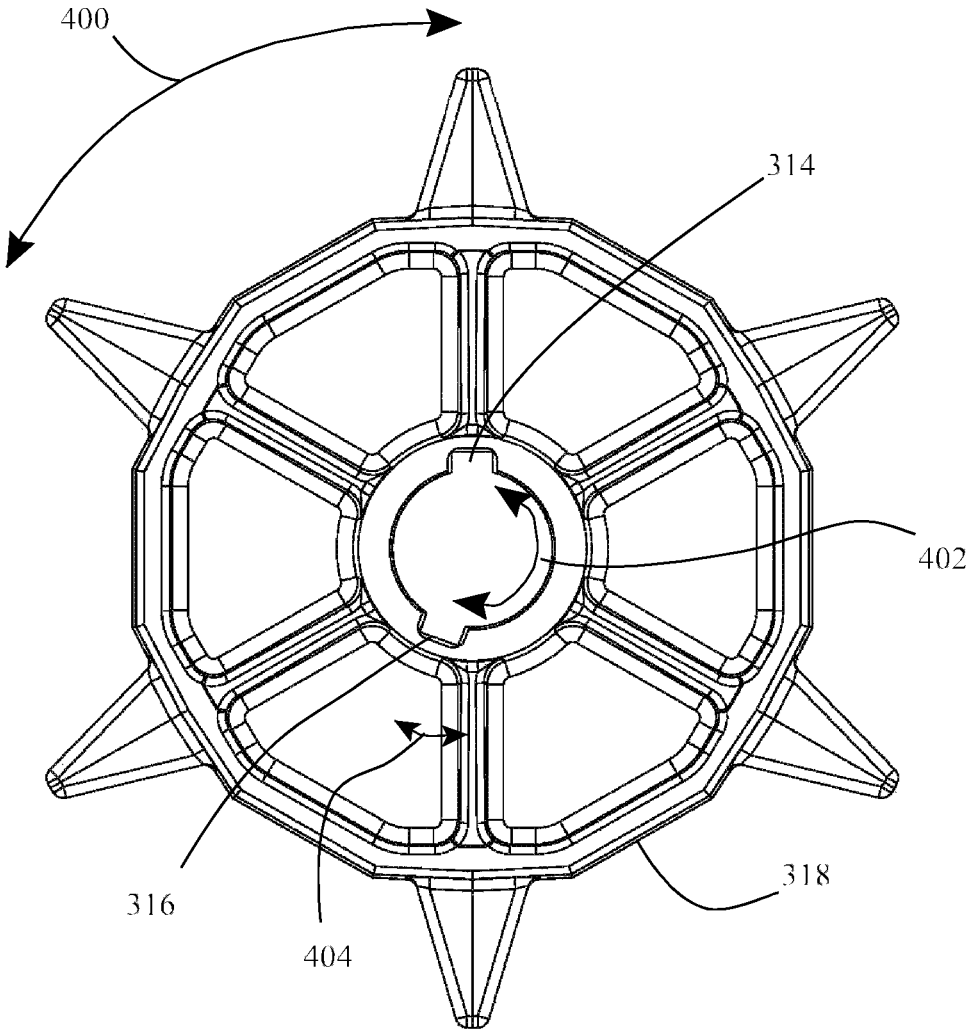
FIG. 6 is a side view of a wheel assembly exemplary embodiment of the invention.

It may be seen that the wheel of FIG. 5 is actually "flipped" when compared to the wheel of FIG. 6.

FIG. 6 is a side view of a wheel assembly exemplary embodiment of the invention. In this view the geometrical basis for the wheel design is laid out. The angle between teeth, "N" is depicted at 400.

The multiple of N/X, that is, the separation of the two keyways 402 is shown: this angle is of course defined to be a multiple of angle N/X 404.

In the presently preferred embodiment of the invention, the wheel is 12 sided, 6 sides having teeth point mounts thereon. The angle between the teeth, "N", is 60 degrees, the number of divisions X is 3, therefore, the angle N/X is 20 degrees. The angle 402 is thus a multiple of 10 (or going the opposite direction about the circle 8) multiples of the 20 degrees. Turning back to FIG. 3 very briefly, it may be seen that the 18 teeth of the three adjacent wheels, seen from the side, are offset or staggered at an angle of 20 degrees.

However, the invention is not so limited. For example, an 8 sided wheel might be used with 8 mount points at 45 degree angles from one another, with an X of 2, that would result in 16 teeth around per two adjacent wheels at 22.5 degree angles and the two keyways being offset by an angle which is a multiple of 22.5, such as 202.5 degrees.

Or, a twelve sided wheel might be used with twelve mount points/teeth at 30 degree angles, and an X of 6, so a stack of five wheels would show no less than 60 teeth at a mere 5 degrees separation from each other. Many numerical combinations are possible.

In other embodiments of the invention, different wheels have different keyways, so the wheels are no longer virtually identical, or no keyways may be used and the wheels fastened on in other ways, etc.

Figure 7:
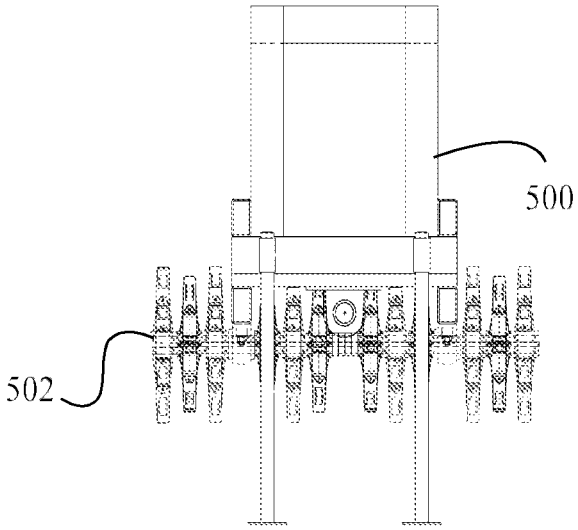
FIG. 7 is a front view of an alternative embodiment of the invention adapted for use on sidewalk and other narrow ways.

In alternative embodiments, different axle lengths may be used to allow different widths of the machine. For example, FIG. 7 is a front view of an alternative embodiment of the invention adapted for use on sidewalk and other narrow ways. Ice breaker 500 has a single axle 502 and is thus sized appropriately for a wide sidewalk or boulevard ice clearance project. On the other hand wider embodiments might be constructed, having more than two axles, for clearing out a land plus a shoulder, or even two lanes, etc. It may also have fewer or more wheels per axle, as may the preferred embodiments: for example this embodiment carries 12 wheels per axle rather than 10, but more or fewer may be used in embodiments.

Obviously the device of the invention may advantageously break up other compacted surfaces such as dirt, slightly improved road with packed chunk asphalt, recycled asphalt and so on.

"Hensley-style" teeth may be used. Such teeth come in a wide variety of sizes and shapes and yet remain largely interchangeable, so a municipality which decided to switch to a more or less aggressive tooth could do so for the cost of the teeth, without actually buying a new ice breaking machine. Thus back hoe teeth may be used, "Tiger" teeth, spade teeth, long teeth, extra-long teeth and so on and so forth.

Another advantage of the invention is extreme customizability for the municipality or other user. By altering the ordering of wheels on the stack/axle, the nature of the angular offset, the selection of teeth, and so on, the end user may customize this device in an extremely wide range of applications and numerical variables. This customization is easy to carry out in any workshop due to the use of pins, keys, spiral-locking-rings and the like. This is in contrast to "drum" designs which can barely be customized at all.

The disclosure is provided to allow practice of the invention by those skilled in the art without undue experimentation, including the best mode presently contemplated and the presently preferred embodiment. Nothing in this disclosure is to be taken to limit the scope of the invention, which is susceptible to numerous alterations, equivalents and substitutions without departing from the scope and spirit of the invention. The scope of the invention is to be understood from the appended claims.

What is claimed is:

1. Ice breaking apparatus adapted to be mounted upon a vehicle; said apparatus comprising:

a frame;

the frame having a forward transverse member and a rear transverse member, the forward transverse member having thereon two sealed spherical plain bearings, the rear transverse member having thereon a further two sealed spherical plain bearings, a first one of the two sealed spherical plain bearings on the forward transverse member facing a first one of the two sealed spherical plain bearings on the rear transverse member, a second one of the two sealed spherical plain bearings on the forward transverse member facing a second one of the two sealed spherical plain bearings on the rear transverse member, whereby first and second facing pairs of sealed spherical plain bearings are made;

a first subframe having at least one pair of trunnion mounts in line with and in between the first pair of sealed spherical plain bearings on the frame, the first pair of sealed spherical plain bearings of the frame and the pair of trunnion mounts of the first subframe having passing therethrough a first trunnion; whereby the first subframe is rotatably supported by the frame;

a second subframe having at least one pair of trunnion mounts in line with and in between the second pair of sealed spherical plain bearings on the frame, the second pair of sealed spherical plain bearings of the frame and the pair of trunnion mounts of the second subframe having passing therethrough a second trunnion; whereby the second subframe is rotatably supported by the frame;

first and second downward extensions on first and second ends of the first subframe having respective first and second facing pillow block bearings thereon to form a first pair of pillow block bearings;

first and second downward extensions on first and second ends of the second subframe having respective first and second facing pillow block bearings thereon to form a second pair of pillow block bearings;

the first pair of pillow block bearings carrying therethrough a first axle disposed underneath the first subframe and perpendicular to the first trunnion;

the second pair of pillow block bearings carrying therethrough a second axle disposed underneath the second subframe and perpendicular to the second trunnion;

the first axle having a first longitudinal keyway, the keyway having a longitudinal key therein, the first axle carrying thereon a first plurality of adjoining wheel assemblies;

the second axle having a second longitudinal keyway, the keyway having a longitudinal key therein, the second axle carrying thereon a second plurality of adjoining wheel assemblies;

each wheel assembly comprising a wheel having a circumference, the circumference bearing regularly spaced projecting point mounts with an angular separation of "N" degrees between adjoining point mounts; the point mounts having pin apertures passing therethrough;

each of the point mounts being a projection dimensioned and configured to accept thereon an asymmetrical heavy equipment tooth held to the point mount by means of a pin passing through the tooth and point mount, the teeth of a single wheel being oriented in a single handedness direction;

the wheel having an aperture therethrough, the wheel carried by one of the two axles passing through the aperture, the aperture having first and second keyways therethrough, the key passing through one of the two keyways and locking the wheel assemblies to prevent rotation in relation to one another, the first and second keyways separated by an angle which is a whole number multiple of N/X degrees, where "X" is itself a second whole number divisible by three;

and further wherein the wheel assemblies are carried on the axle in a particular order, with a first wheel having teeth oriented in a first direction and the key passing through the first keyway; an adjoining second wheel having teeth oriented in the first direction and the key passing through the second keyway, and a third wheel adjoining the second wheel, the third wheel having the teeth oriented in a second direction but the third wheel being flipped 180 degrees from the first and second wheels and having the key passing through the second keyway, whereby each of the three wheels is mounted at a different angle.

2. The ice breaking apparatus of claim 1, wherein "N" is 60 degrees, "X" the second whole number is 3, and N/X is thus 20 degrees, and thus whereby the first and second keyways are separated by an angle which is a whole number multiple of 20 degrees.

3. The ice breaking apparatus of claim 1, wherein the first whole number is 10, whereby the first and second keyways are separated by an angle of 200 degrees.

4. The ice breaking apparatus of claim 1, whereby each axle bears at each end a spiral-locking-ring, and where each trunnion bears at each end a spiral-locking-ring, and also bears a spiral-locking-ring disposed inward of the sealed spherical plain bearings, whereby the wheel assemblies, and subframes are secured onto the axles.

5. The ice breaking apparatus of claim 1, wherein the frame further comprises a plurality of vertical members attached to and rising from the rear transverse member; and further comprises an upper rear transverse member parallel to the rear transverse member and above it, the upper rear transverse member attached to such vertical members, and further comprises diagonal members attached to the upper rear transverse member and the forward transverse member, and yet further comprises horizontal members attached to such forward and rear transverse members.

6. The ice breaking apparatus of claim 1, further comprising at least one spacer upon each axle at a location directly beneath the respective trunnion.

7. The ice breaking apparatus of claim 1, whereby the shape of the wheel is multi-sided.

8. The ice breaking apparatus of claim 1, wherein the aperture further comprises raised lands about the aperture, the raised lands having a width greater than the width of the wheel assembly so that adjoining wheels are maintained in a spaced apart relationship; the raised lands having reliefs disposed within the aperture at the keyways.

9. The ice breaking apparatus of claim 1, further comprising: spacer rings carried upon the axles in between each pair of adjoining wheels, whereby the adjoining wheels are maintained in a spaced apart relationship.

10. Ice breaking apparatus adapted to be mounted upon a vehicle; said apparatus comprising:

a frame;

the frame having a forward transverse member and a rear transverse member, the forward transverse member having thereon a sealed spherical plain bearing, the rear transverse member having thereon a second sealed spherical plain bearing, the first and second sealed spherical plain bearings facing one another, a subframe having at least one pair of trunnion mounts in line with and in between the first pair of sealed spherical plain bearings on the frame, the first pair of sealed spherical plain bearings of the frame and the pair of trunnion mounts of the first subframe having passing therethrough a trunnion; whereby the first subframe is rotatably supported by the frame;

first and second downward extensions on first and second ends of the subframe having respective first and second facing pillow block bearings thereon to form a pair of pillow block bearings;

the pair of pillow block bearings carrying therethrough an axle disposed underneath the subframe and perpendicular to the trunnion;

the axle having a longitudinal keyway, the keyway having a longitudinal key therein, the axle carrying thereon a plurality of adjoining wheel assemblies;

each wheel assembly comprising a wheel having a circumference, the circumference bearing regularly spaced projecting point mounts with an angular separation of "N" degrees between adjoining point mounts; the point mounts having pin apertures passing therethrough;

each of the point mounts being a projection dimensioned and configured to accept thereon an asymmetrical heavy equipment tooth held to the point mount by means of a pin passing through the tooth and point mount, the teeth of a single wheel being oriented in a single handedness direction;

the wheel having an aperture therethrough, the wheel carried by the axle passing through the aperture, the aperture having first and second keyways therethrough, the key passing through one of the two keyways and locking the wheel assemblies to prevent rotation in relation to one another, the first and second keyways separated by an angle which is a whole number multiple of N/X degrees, where "X" is itself a second whole number divisible by three;

and further wherein the wheel assemblies are carried on the axle in a particular order, with a first wheel having teeth oriented in a first direction and the key passing through the first keyway; an adjoining second wheel having teeth oriented in the first direction and the key passing through the second keyway, and a third wheel adjoining the second wheel, the third wheel having the teeth oriented in a second direction but the third wheel being flipped 180 degrees from the first and second wheels and having the key passing through the second keyway, whereby each of the three wheels is mounted at a different angle relative to the axle.

* * * * *